US011069979B2

(12) United States Patent
Yang

(10) Patent No.: US 11,069,979 B2
(45) Date of Patent: Jul. 20, 2021

(54) VERTICALLY POLARIZED OMNIDIRECTIONAL ANTENNA AND DUAL-POLARIZATION OMNIDIRECTIONAL ANTENNA THEREOF

(71) Applicant: SHENZHEN ANTOP TECHNOLOGY LIMITED, Guangdong (CN)

(72) Inventor: Ruidian Yang, Guangdong (CN)

(73) Assignee: SHENZHEN ANTOP TECHNOLOGY LIMITED, Guangdong (CN)

( * ) Notice: Subject to any disclaimer, the term of this patent is extended or adjusted under 35 U.S.C. 154(b) by 118 days.

(21) Appl. No.: 16/441,675

(22) Filed: Jun. 14, 2019

(65) Prior Publication Data

US 2020/0328532 A1 Oct. 15, 2020

(30) Foreign Application Priority Data

Apr. 12, 2019 (CN) ..... 201910295516.6

(51) Int. Cl.
*H01Q 9/40* (2006.01)
*H01Q 1/36* (2006.01)
(Continued)

(52) U.S. Cl.
CPC ..... *H01Q 9/40* (2013.01); *H01Q 1/1207* (2013.01); *H01Q 1/36* (2013.01); *H01Q 1/50* (2013.01);
(Continued)

(58) Field of Classification Search
CPC ..... H01Q 1/12; H01Q 1/1207; H01Q 1/18; H01Q 1/27; H01Q 1/32; H01Q 1/325;
(Continued)

(56) References Cited

U.S. PATENT DOCUMENTS 7,027,004 B2 * 4/2006 Haunberger ..... H01Q 1/40 343/790
2005/0146471 A1 * 7/2005 Kwon ..... H01Q 9/28 343/702

(Continued)

*Primary Examiner* — Robert Karacsony
(74) *Attorney, Agent, or Firm* — Muncy, Geissler, Olds and Lowe, P.C.

(57) ABSTRACT

The invention discloses a vertically polarized omnidirectional antenna that is fed by a coaxial line including an inner conductor and an outer conductor. The vertically polarized omnidirectional antenna includes a main vibrator, an insulating medium, and a reference ground which are sequentially stacked and sequentially connected in a top-down manner. The main vibrator includes two vibrator pieces arranged in a crisscross, a straight line where an intersecting line between the vibrator pieces is located perpendicularly passes through the center of the reference ground, a base angle of each vibrator piece is set to be a corner cut, the inner conductor passes through the center of the reference ground and the insulating medium and is connected with the bottom of the main vibrator, and the outer conductor is connected with the reference ground. The vertically polarized omnidirectional antenna stably receives vertically polarized television signals from various directions through cooperatively interaction between the main vibrator, the insulating medium and the reference ground. The insulating medium is a key element of adjusting antenna impedance and being effective in impedance matching, so that an effect of receiving vertically polarized television signals from various directions by the antenna is greatly improved, the impedance is stable, and signal receiving stability and signal quality are greatly improved.

9 Claims, 10 Drawing Sheets

(51) Int. Cl.

| | |
|---|---|
| ***H01Q 1/50*** | (2006.01) |
| ***H01Q 21/24*** | (2006.01) |
| ***H01Q 1/12*** | (2006.01) |
| ***H01Q 21/28*** | (2006.01) |
| ***H01Q 13/10*** | (2006.01) |
| ***H01Q 21/20*** | (2006.01) |

(52) U.S. Cl.
CPC ..... *H01Q 13/10* (2013.01); *H01Q 21/205* (2013.01); *H01Q 21/24* (2013.01); *H01Q 21/28* (2013.01)

(58) Field of Classification Search
CPC ..... H01Q 1/3275; H01Q 1/36; H01Q 1/38; H01Q 1/50; H01Q 5/25; H01Q 9/0464; H01Q 9/30; H01Q 9/32; H01Q 9/36; H01Q 9/38; H01Q 9/40; H01Q 9/44; H01Q 9/46; H01Q 21/24; H01Q 21/26; H01Q 21/28
See application file for complete search history.

(56) References Cited

U.S. PATENT DOCUMENTS

2010/0019979 A1* 1/2010 Buxton ..... H01Q 9/28 343/722
2013/0285877 A1* 10/2013 Desclos ..... H01Q 5/371 343/872

* cited by examiner

VERTICALLY POLARIZED OMNIDIRECTIONAL ANTENNA AND DUAL-POLARIZATION OMNIDIRECTIONAL ANTENNA THEREOF

TECHNICAL FIELD

The invention relates to the technical field of antennas, in particular to a vertically polarized omnidirectional antenna and a dual-polarization omnidirectional antenna thereof.

BACKGROUND ART

An antenna is a component used in radio equipment to transmit or receive electromagnetic waves. Any engineering system, which uses electromagnetic waves to convey information, such as wireless communication, broadcasting, television, radar, navigation, electronic countermeasure, remote sensing, radio astronomy, and the like, works by means of an antenna. With the popularity of wireless digital television signals, television signals are received outdoors or in movement by more and more people rather than limited in doors. When television signals are received outdoors, especially in movement, since a signal tower is stationary while a position of a receive antenna is constantly changing, an omnidirectional antenna is required to ensure better reception.

The omnidirectional antenna exhibits 360° uniform radiation on a horizontal pattern, which is commonly referred to as non-directionality, has a large coverage range, and exhibits to be a beam having a certain width in a vertical pattern. In general, the smaller the width of a lobe is, the greater the gain is. From the perspective of a current receive antenna on the market, a single-polarization receive vibrator is generally used in receiving UHF signals, either horizontally polarized or vertically polarized, and especially a vibrator of the omnidirectional antenna is mostly horizontally polarized. If a vertically polarized electromagnetic wave signal emitted from a television tower is to be received, the antenna has to be repositioned, which is very inconvenient for an antenna installed outdoors.

SUMMARY OF THE INVENTION

In view of the above, the invention provides a vertically polarized omnidirectional antenna with stable impedance and high signal receiving quality to overcome at least one of the above-mentioned defects in the prior art.

In order to solve the above existing technical problems, the invention adopts technical solutions as follows.

The vertically polarized omnidirectional antenna that is fed by a coaxial line including an inner conductor and an outer conductor includes a main vibrator, an insulating medium, and a reference ground which are sequentially stacked and sequentially connected in a top-down manner. The main vibrator includes two vibrator pieces arranged in a crisscross, a straight line where an intersecting line between the vibrator pieces is located perpendicularly passes through the center of the reference ground, a base angle of each vibrator piece is set to be a corner cut, the inner conductor passes through the center of the reference ground and the insulating medium and is connected with the bottom of the main vibrator, and the outer conductor is connected with the reference ground.

The vertically polarized omnidirectional antenna stably receives vertically polarized television signals from various directions through cooperatively interaction between the main vibrator, the insulating medium and the reference ground. The insulating medium is a component to position a relative position of the main vibrator and the reference ground, as well as a key element of adjusting antenna impedance and being effective in impedance matching, so that an effect of receiving vertically polarized television signals from various directions by the antenna is greatly improved, the impedance is stable, and signal receiving stability and signal quality are greatly improved. The main vibrator includes two vibrator pieces arranged in a crisscross, that is, the vibrator pieces are vertically intersected with each other, and the intersected line superposes a center line of each vibrator piece and is perpendicular to a plane where the reference ground is located. A base angle of the vibrator piece is cut to be a corner cut, that is, at least a lower part of the vibrator piece is an inverted trapezoidal structure so as to ensure that a bottom edge of the vibrator piece can be in stable and effective contact with the insulating medium. The main vibrator is funnel-shaped from a side view and has the same receiving principle with a vibrator of a conical antenna, but is easier to process and manufacture and suitable for mass production compared with the vibrator of the conical antenna. The reference ground is made to ensure stability of antenna parameters.

In order to reduce the size of the main vibrator as much as possible, an upper part of a side edge of the vibrator piece is provided with a plurality of strip-shaped notches arranged parallel to each other and parallel to a horizontal plane. On one hand, the arrangement of the strip-shaped notches can expand low-frequency receiving of a UHF signal, and on the other hand, can improve characteristic impedance of the vibrator to achieve best matching. Bandwidth and matching impedance are improved by designing a position and a width of the strip-shaped notches. After simulation and measurement, when the width of the strip-shaped notch is 5 mm to 10 mm and a length is 10 mm to 40 mm, the signal receiving quality and stability are optimal.

The corner cut is chamfered from a middle part of a side edge of the vibrator piece to a middle part of a bottom edge of the vibrator such that a lower part of the vibrator piece is an inverted trapezoidal structure. A design of the position of the corner cut, on one hand, can expand bandwidth, improve pattern non-circularity, and further improve a receiving effect of the antenna; and on the other hand, allows the strip-shaped notch to be arranged on an upper part of the vibrator piece. A combined function of the two further improves the receiving effect of the antenna.

In order to improve connection stability between the vibrator pieces, one vibrator piece of the main vibrator is provided with a gap extending to a middle part along a center line in a top-down manner, the other vibrator piece is provided with a gap extending to the middle part along the center line in a bottom-up manner, and the two vibrator pieces form a crisscross structure by fitting the gaps in a crossed manner. In order to further improve connection stability between the vibrator pieces, two sides of the gap are symmetrical toothed structures and are integrally formed in a string shape, so as to improve directivity of signal transmission, improve signal quality, and meanwhile lower assembly difficulty.

In order to stabilize the antenna, the insulating medium is provided with four supports, each support is provided with a slot, the slots of the four supports form a cross matched with the main vibrator, and the vibrator piece is inserted into the slot to be fixed. In a case where the antenna is installed and applied to a moving object such as a vehicle, a ship or the like, the vibrator is ensured not to sway or deform when the vehicle or the ship moves quickly so as to ensure a receiving effect.

An inner side surface of the slot is provided with a plurality of protrusions in order to further improve assembly stability of the main vibrator, combing an impedance matching effect, and lower assembly difficulty. Preferably, the support is provided with a fastener penetrating through the vibrator piece, so as to further improve a stability degree of the antenna.

The reference ground is punched with a convex groove or a concave groove which is favorable to reduce the size of the reference ground so as to meet a requirement of overall miniaturization for the antenna.

The vertically polarized omnidirectional antenna further includes a base and a housing covered above the base. A closed cavity is formed between the base and the housing. The main vibrator, the insulating medium, and the reference ground are arranged in the cavity. The main vibrator is fixedly connected to an upper side of the insulating medium, the reference ground is fixedly connected to a lower side of the insulating medium and the insulating medium is fixedly connected to the base through the fastener so as to ensure integrity between the main vibrator, the insulating medium and the reference ground and ensure stability of signal receiving.

An inner side of the base is further provided with a VHF vibrator arranged at a distance from the reference ground in a direction perpendicular to the reference ground. The VHF vibrator is a dipole vibrator and includes a pair of curved strap-shaped vibrator pieces which are arranged symmetrically. Projection of the strap-shaped vibrator pieces on a plane parallel to the reference ground is shown as a pair of symmetrically arranged arcs with arc centers opposite to each other, which reduces a circumferential size of an integrated antenna and better achieves miniaturization of the integrated antenna under the premise of ensuring a length and input impedance of the vibrator. The arrangement of a layout surrounding the vertically polarized omnidirectional antenna in the plane parallel to the reference ground and being arranged at a distance from the vertically polarized omnidirectional antenna further ensures reception of a VHF frequency band signal, and has no influence on signal reception of other antenna vibrators.

A dual-polarization omnidirectional antenna that is provided with the vertically polarized omnidirectional antenna further includes a horizontally polarized omnidirectional antenna arranged at a distance above the vertically polarized omnidirectional antenna. The horizontally polarized omnidirectional antenna includes a substrate and a vibrator, the vibrator is connected to a signal processor through a coaxial cable, the vibrator includes a wiring port that is arranged at the center of the substrate and is used to connect with the coaxial cable and a plurality of vibrator units distributed on the substrate in a circumferential array around the center of the substrate, the vibrator unit includes a radiating unit and a conducting unit, the radiating unit includes a first radiating sheet parallelly arranged on the substrate and a second radiating sheet vertically arranged on an edge of the substrate, an outer side edge of the first radiating sheet is connected with an inner side surface of the second radiating sheet, the conducting unit is parallelly arranged on the substrate, one end of the conducting unit is connected with one end of the first radiating sheet, and the other end is connected with the wiring port.

The vertically polarized omnidirectional antenna of the invention is combined with the above-mentioned horizontally polarized omnidirectional antenna, as long as a relatively smaller space is kept between the two antennas, mutual interference between the two antennas will not be caused, and miniaturization development of the antenna is facilitated.

The dual-polarization omnidirectional antenna further includes a VHF vibrator arranged at a distance below the vertically polarized omnidirectional antenna. The VHF vibrator is a dipole vibrator and includes a pair of curved strap-shaped vibrator pieces which are arranged symmetrically. Projection of the strap-shaped vibrator pieces on a plane parallel to the reference ground is shown as a pair of symmetrically arranged arcs with arc centers opposite to each other, which reduces a circumferential size of an integrated antenna and better achieves miniaturization of the integrated antenna under the premise of ensuring a length and input impedance of the vibrator. The arrangement of a layout surrounding the vertically polarized omnidirectional antenna or the horizontally polarized omnidirectional antenna in the plane parallel to the reference ground and being arranged at a distance from the vertically polarized omnidirectional antenna further ensures reception of a VHF frequency band signal, and has no influence on signal reception of other antenna vibrators.

The dual-polarization omnidirectional antenna further includes a base and a housing covered above the base. A closed cavity is formed between the base and the housing. The horizontally polarized omnidirectional antenna, the vertically polarized omnidirectional antenna, and the VHF vibrator are sequentially arranged in the cavity in a top-down manner. The horizontally polarized omnidirectional antenna is connected to the top of the housing through the substrate to be fixed, the main vibrator of the vertically polarized omnidirectional antenna is fixedly connected to an upper side of the insulating medium, the reference ground is fixedly connected to a lower side of the insulating medium, and the insulating medium is fixedly connected to the base through the fastener, so as to ensure integrity between the main vibrator, the insulating medium and the reference ground and ensure stability of signal receiving. The VHF vibrator surrounds an inner wall of the base.

Compared with the prior art, beneficial effects of the invention are as follows. The vertically polarized omnidirectional antenna stably receives vertically polarized television signals from various directions through cooperatively interaction between the main vibrator, the insulating medium and the reference ground. The insulating medium is a component to position a relative position of the main vibrator and the reference ground, as well as a key element of adjusting antenna impedance and being effective in impedance matching, so that an effect of receiving vertically polarized television signals from various directions by the antenna is greatly improved, the impedance is stable, and signal receiving stability and signal quality are greatly improved. At least a lower part of the vibrator piece is an inverted trapezoidal structure so as to ensure that a bottom edge of the vibrator piece can be in stable and effective contact with the insulating medium. The main vibrator is funnel-shaped from a side view and has the same receiving principle with a vibrator of a funnel antenna, but is easier to process and manufacture and suitable for mass production compared with the vibrator of the funnel antenna. On one hand, the arrangement of the strip-shaped notches can expand low-frequency receiving of a UHF signal, and on the other hand, can improve characteristic impedance of the vibrator to achieve best matching.

Figure 1:
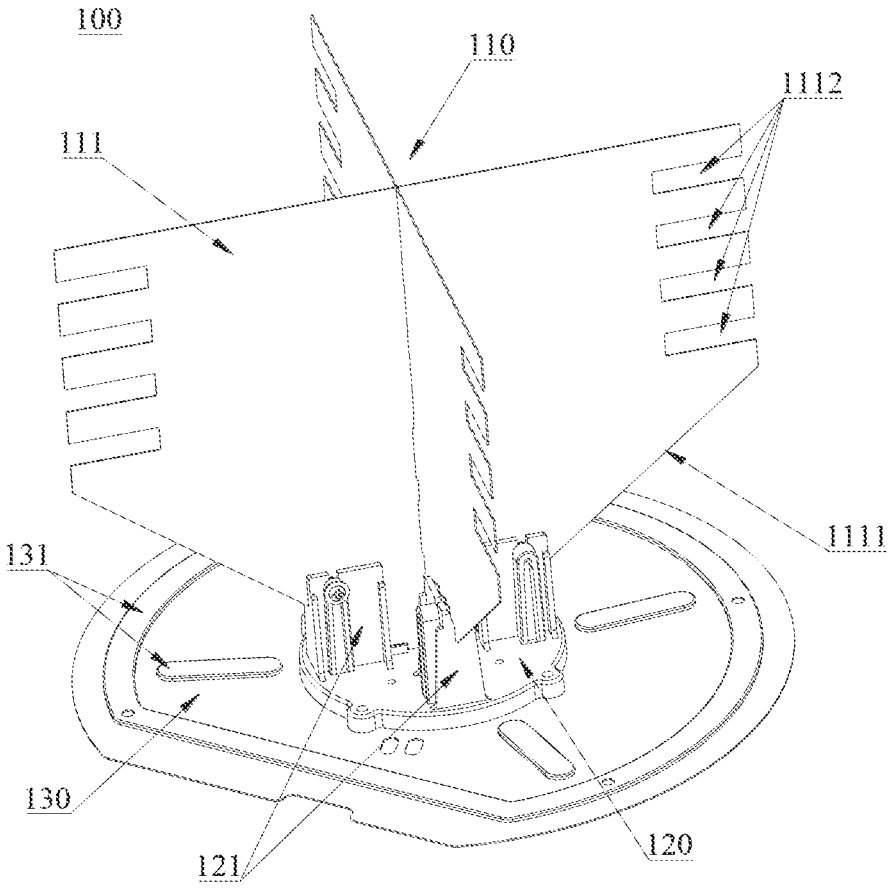
FIG. 1 is a schematic diagram of a vertically polarized omnidirectional antenna.

Reference Numerals: 100 vertically polarized omnidirectional antenna; 110 main vibrator; 111 vibrator piece; 1111 corner cut; 1112 strip-shaped notch; 1113 gap; 120 insulating medium; 121 support; 1211 slot; 130 reference ground; 131 convex groove; 200 horizontally polarized omnidirectional antenna; 210 substrate; 221 wiring port; 2221 radiating unit; 2222 conducting unit; 300 VHF vibrator; 400 coaxial line; 410 inner conductor; 420 outer conductor; 510 base; 520 housing

DESCRIPTION OF EMBODIMENTS

The drawings of the present invention are for illustration purpose only and are not intended to limit the present invention. Some components in the drawings are omitted, enlarged or reduced for better illustrating the embodiments, and sizes of these components do not represent sizes of actual product. For those skilled in the art, it will be understood that some known structures in the drawings and descriptions thereof are omitted. The description of positional relationship in the drawings is for illustration purpose only and is not intended to limit the present invention. The present invention will be further illustrated below with reference to specific embodiments.

Embodiment 1

Figure 2:
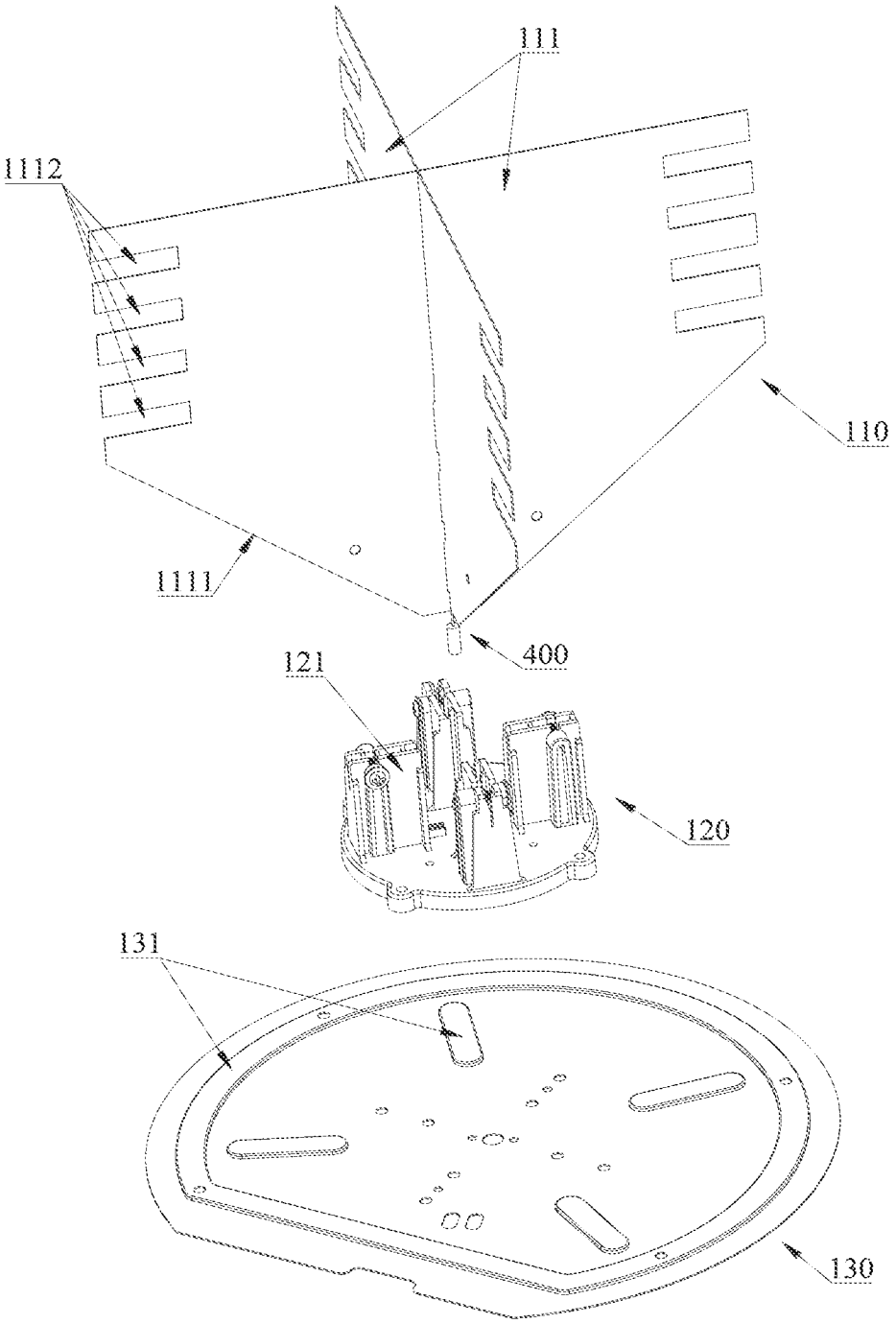
FIG. 2 is an exploded view of the vertically polarized omnidirectional antenna.
Figure 3:
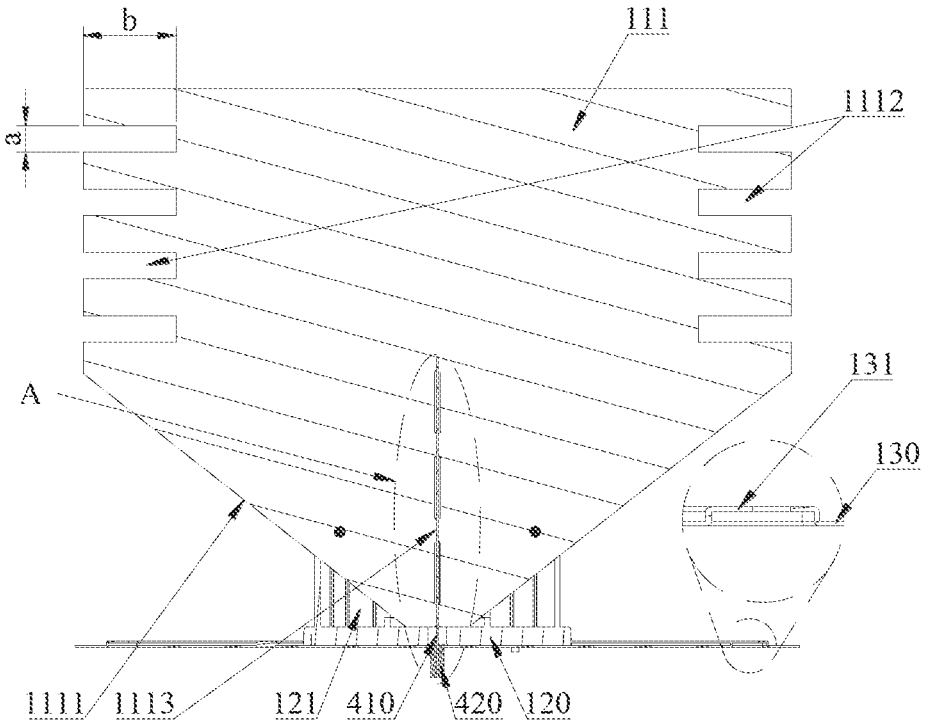
FIG. 3 is a cross-sectional view of the vertically polarized omnidirectional antenna.

As shown in FIGS. 1 to 3, a vertically polarized omnidirectional antenna 100 that is fed by a coaxial line 400 including an inner conductor 410 and an outer conductor 420 includes a main vibrator 110, an insulating medium 120, and a reference ground 130, which are sequentially stacked and sequentially connected in a top-down manner. The main vibrator 110 includes two vibrator pieces 111 arranged in a crisscross, a straight line where an intersecting line between the vibrator pieces 111 is located perpendicularly passes through the center of the reference ground 130, a base angle of each vibrator piece 111 is set to be a corner cut 1111, the inner conductor 410 passes through the center of the reference ground 130 and the insulating medium 120 and is connected with the bottom of the main vibrator 110, and the outer conductor 420 is connected with the reference ground 130.

The vertically polarized omnidirectional antenna 100 of the present embodiment stably receives vertically polarized television signals from various directions through cooperatively interaction between the main vibrator 110, the insulating medium 120 and the reference ground 130. The insulating medium 120 is a component to position a relative position of the main vibrator 110 and the reference ground 130, as well as a key element of adjusting antenna impedance and being effective in impedance matching, so that an effect of receiving vertically polarized television signals from various directions by the antenna is greatly improved, the impedance is stable, and signal receiving stability and signal quality are greatly improved. The main vibrator 110 includes two vibrator pieces 111 arranged in a crisscross, that is, the vibrator pieces 111 are vertically intersected with each other, and the intersected line superposes a center line of each vibrator piece 111 and is perpendicular to a plane where the reference ground 130 is located. A base angle of the vibrator piece 111 is cut to be a corner cut 1111, that is, at least a lower part of the vibrator piece 111 is an inverted trapezoidal structure so as to ensure that a bottom edge of the vibrator piece 111 can be in stable and effective contact with the insulating medium 120. The main vibrator 110 is funnel-shaped from a side view and has the same receiving principle with a vibrator of a funnel antenna, but is easier to process and manufacture and suitable for mass production compared with the vibrator of the funnel antenna.

Figure 4:
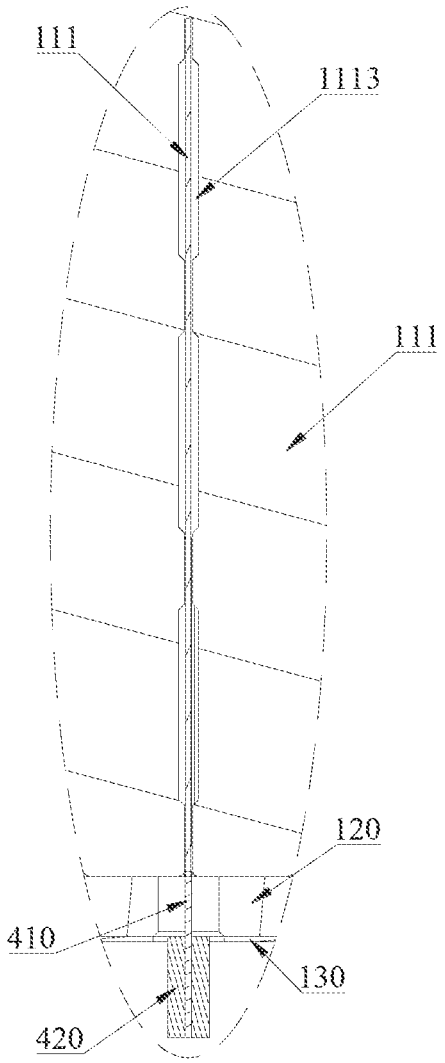
FIG. 4 is an enlarged view of an A part in FIG. 3.

As shown in FIG. 4, in order to reduce the size of the main vibrator 110 as much as possible, an upper part of a side edge of the vibrator piece 111 is provided with a plurality of strip-shaped notches 1112 arranged parallel to each other and parallel to a horizontal plane. On one hand, the arrangement of the strip-shaped notches 1112 can expand low-frequency receiving of a UHF signal, and on the other hand, can improve characteristic impedance of the vibrator to achieve best matching. A receiving effect can be optimal by designing a position and a width of the strip-shaped notches 1112. After simulation and measurement, when a width a of the strip-shaped notch 1112 is 5 mm to 10 mm and a length b is 10 mm to 40 mm, the signal receiving quality and stability are optimal.

As shown in FIG. 4, the corner cut 1111 is chamfered from the middle of a side edge of the vibrator piece 111 to the middle of a bottom edge of the vibrator such that a lower part of the vibrator piece 111 is an inverted trapezoidal structure. A design of the position of the corner cut 1111, on one hand, can expand bandwidth, improve pattern non-circularity, and further improve a receiving effect of the antenna; and on the other hand, allows the strip-shaped notch 1112 to be arranged on the upper part of the vibrator piece 111. A combined function of the two further improves the receiving effect of the antenna.

Figure 5:
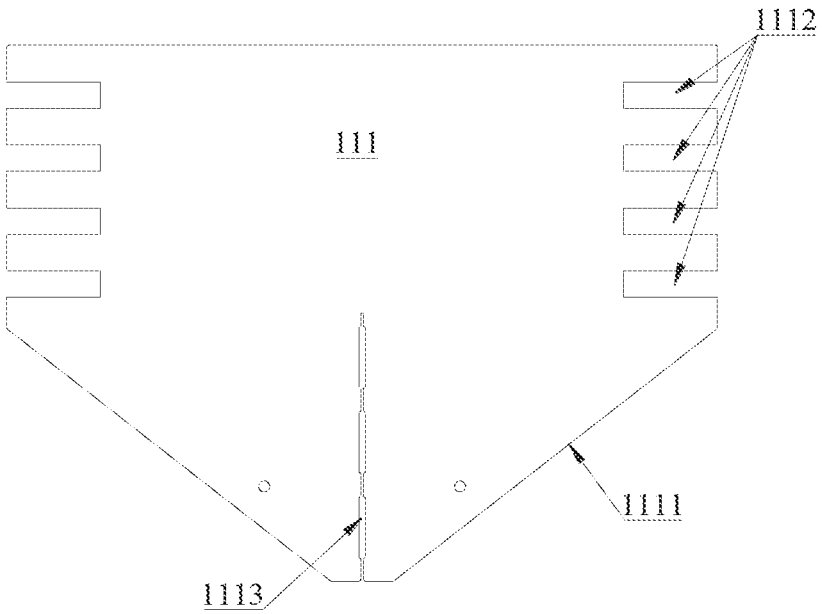
FIG. 5 is a first front view of a vibrator piece.
Figure 6:
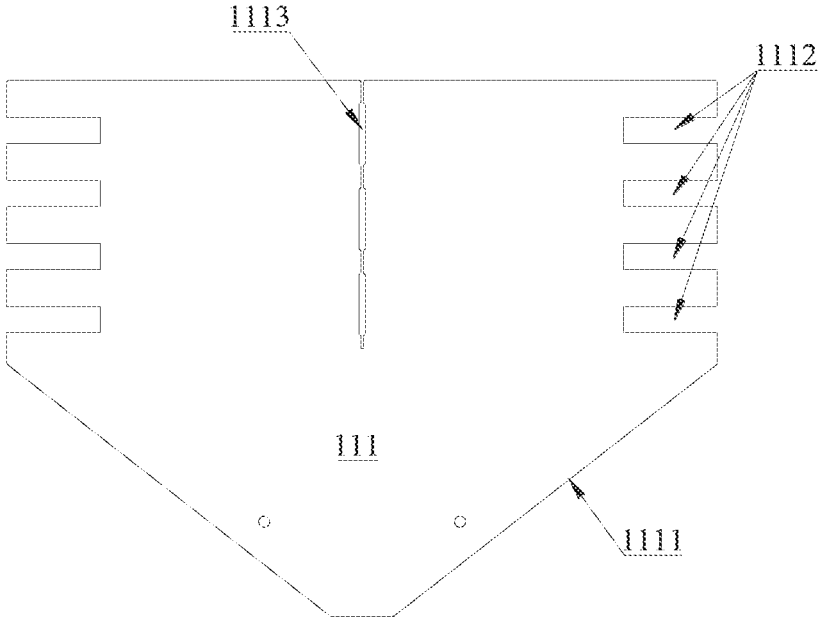
FIG. 6 is a second front view of the vibrator piece.
Figure 7:
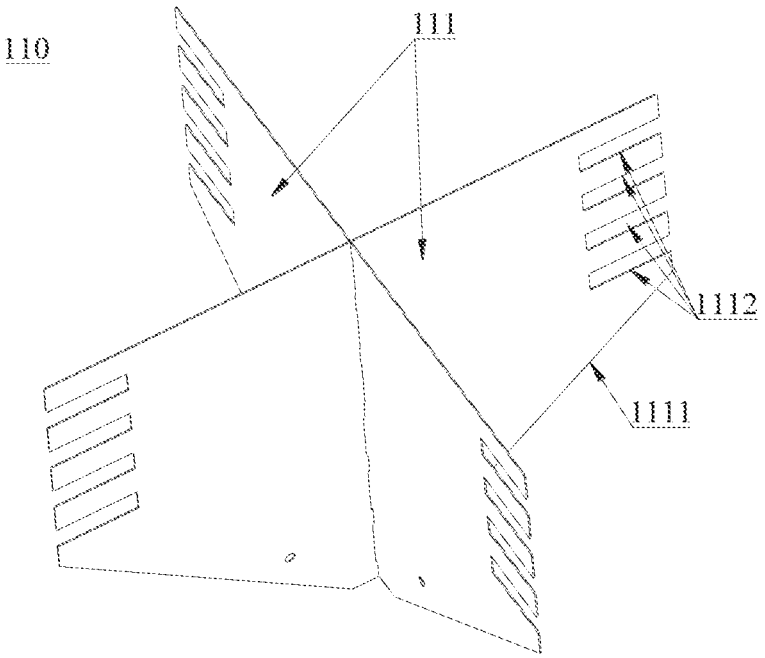
FIG. 7 is a schematic diagram of a main vibrator.

In order to improve connection stability between the vibrator pieces 111, one vibrator piece 111 of the main vibrator 110 is provided with a gap 1113 (shown in FIG. 5) extending to a middle part along a center line in a top-down manner, the other vibrator piece 111 is provided with a gap 1113 (shown in FIG. 6) extending to the middle part along the center line in a bottom-up manner, and the two vibrator pieces 111 form a crisscross structure (shown in FIG. 7) by fitting the gaps 1113 in a crossed manner. In order to further improve connection stability between the vibrator pieces 111, as shown in FIG. 4, two sides of the gap 1113 are symmetrical toothed structures and are integrally formed in a string shape, so as to improve directivity of signal transmission, improve signal quality, and meanwhile lower assembly difficulty.

Figure 8:
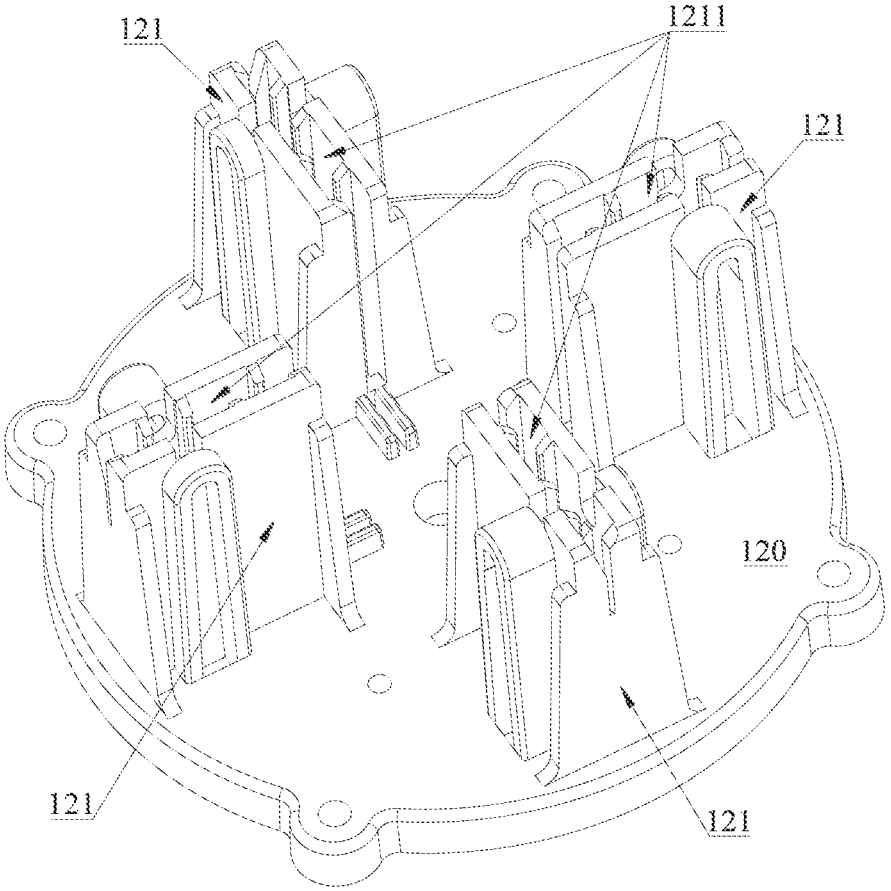
FIG. 8 is a schematic diagram of an insulating medium.

In order to stabilize the antenna, as shown in FIG. 8, the insulating medium 120 is provided with four supports 121, each support 121 is provided with a slot 1211, the slots 1211 of the four supports 121 form a cross matched with the main vibrator 110, and the vibrator piece 111 is inserted into the slot 1211 to be fixed. In a case where the antenna is installed and applied to a moving object such as a vehicle, a ship or the like, the vibrator is ensured not to sway or deform when the vehicle or the ship moves quickly so as to ensure a receiving effect.

As shown in FIG. 3, an inner side surface of the slot 1211 is provided with a plurality of protrusions in order to further improve assembly stability of the main vibrator 110, combing an impedance matching effect, and lower assembly difficulty. Preferably, the support 121 is provided with a fastener penetrating through the vibrator piece 111, so as to further improve a stability degree of the antenna.

Figure 9:
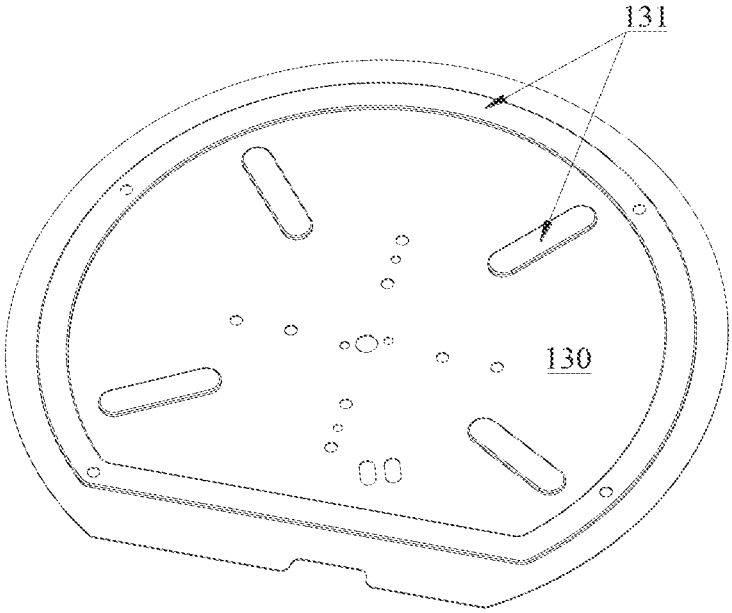
FIG. 9 is a schematic diagram of a reference ground.

As shown in FIG. 9, the reference ground 130 is punched with a convex groove 131 or a concave groove which is favorable to reduce the size of the reference ground 130 so as to meet a requirement of overall miniaturization for the antenna.

Figure 10:
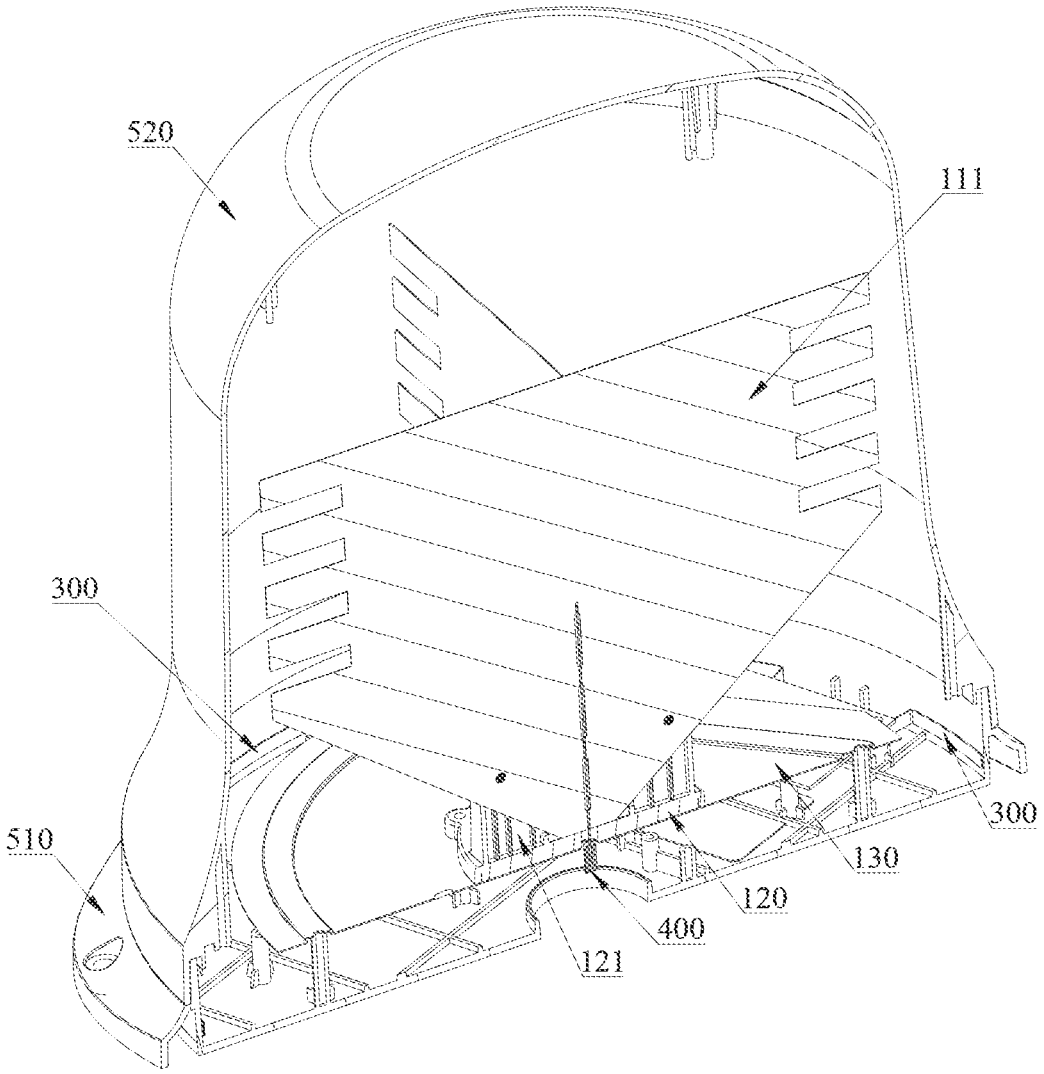
FIG. 10 is a second schematic diagram of the vertically polarized omnidirectional antenna.

As shown in FIG. 10, the vertically polarized omnidirectional antenna 100 further includes a base 510 and a housing 520 covered above the base 510. A closed cavity is formed between the base 510 and the housing 520. The main vibrator 110, the insulating medium 120, and the reference ground 130 are arranged in the cavity. The main vibrator 110 is fixedly connected to an upper side of the insulating medium 120, the reference ground 130 is fixedly connected to a lower side of the insulating medium 120, and the insulating medium 120 is fixedly connected to the base 510 through the fastener, so as to ensure integrity between the main vibrator 110, the insulating medium 120 and the reference ground 130 and ensure stability of signal receiving.

An inner side of the base 510 is further provided with a VHF vibrator 300 arranged at a distance from the reference ground 130 in a direction perpendicular to the reference ground 130, the VHF vibrator 300 is a dipole vibrator and includes a pair of curved strap-shaped vibrator pieces 111 which are arranged symmetrically. Projection of the strap-shaped vibrator pieces 111 on a plane parallel to the reference ground 130 is shown as a pair of symmetrically arranged arcs with arc centers opposite to each other, which reduces a circumferential size of an integrated antenna and better achieves miniaturization of the integrated antenna under the premise of ensuring a length and input impedance of the vibrator. The arrangement of a layout surrounding the vertically polarized omnidirectional antenna 100 in the plane parallel to the reference ground 130 and being arranged at a distance from the vertically polarized omnidirectional antenna 100 further ensures reception of a VHF frequency band signal, and has no influence on signal reception of other antenna vibrators.

Embodiment 2

Figure 11:
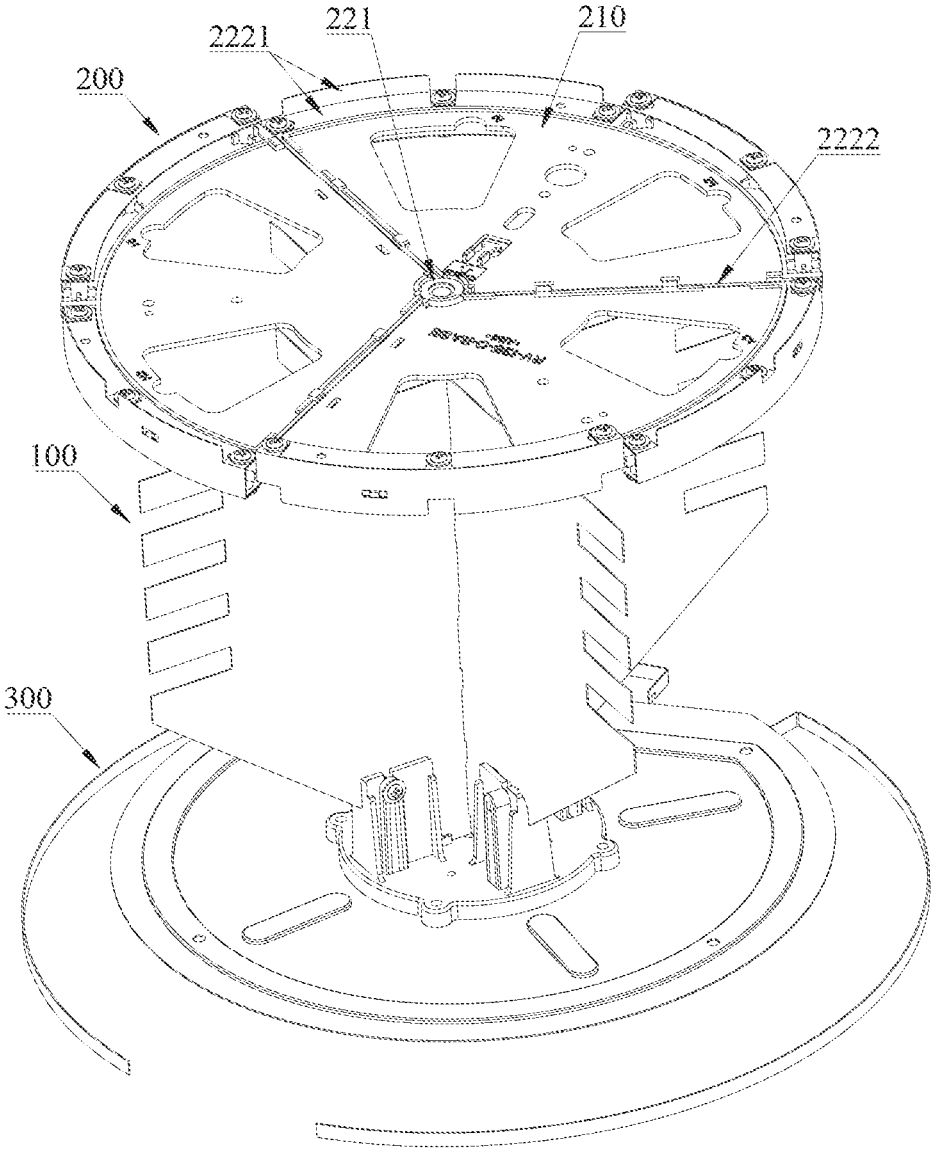
FIG. 11 is a schematic diagram of a dual-polarization omnidirectional antenna.

As shown in FIG. 11, a dual-polarization omnidirectional antenna that is provided with the vertically polarized omnidirectional antenna 100 as described in the above embodiment further includes a horizontally polarized omnidirectional antenna 200 arranged at a distance above the vertically polarized omnidirectional antenna 100. The horizontally polarized omnidirectional antenna 200 includes a substrate 210 and a vibrator, the vibrator is connected to a signal processor through a coaxial cable, the vibrator includes a wiring port 221 that is arranged at the center of the substrate 210 and is used to connect with the coaxial cable and a plurality of vibrator units distributed on the substrate 210 in a circumferential array around the center of the substrate 210, the vibrator unit includes a radiating unit 2221 and a conducting unit 2222, the radiating unit 2221 includes a first radiating sheet parallelly arranged on the substrate 210 and a second radiating sheet vertically arranged on an edge of the substrate 210, an outer side edge of the first radiating sheet is connected with an inner side surface of the second radiating sheet, the conducting unit 2222 is parallelly arranged on the substrate 210, one end of the conducting unit 2222 is connected with one end of the first radiating sheet, and the other end is connected with the wiring port 221.

The vertically polarized omnidirectional antenna 100 of the present embodiment is combined with the above-mentioned horizontally polarized omnidirectional antenna 200, as long as a relatively smaller space is kept between the two antennas, mutual interference between the two antennas will not be caused, and miniaturization development of the antenna is facilitated.

The dual-polarization omnidirectional antenna further includes a VHF vibrator 300 arranged at a distance below the vertically polarized omnidirectional antenna 100. The VHF vibrator 300 is a dipole vibrator and includes a pair of curved strap-shaped vibrator pieces 111 which are arranged symmetrically. Projection of the strap-shaped vibrator pieces 111 on a plane parallel to the reference ground 130 is shown as a pair of symmetrically arranged arcs with arc centers opposite to each other, which reduces a circumferential size of an integrated antenna and better achieves miniaturization of the integrated antenna under the premise of ensuring a length and input impedance of the vibrator. The arrangement of a layout surrounding the vertically polarized omnidirectional antenna 100 or the horizontally polarized omnidirectional antenna 200 in the plane parallel to the reference ground 130 and being arranged at a distance from the vertically polarized omnidirectional antenna 100 further ensures reception of a VHF frequency band signal, and has no influence on signal reception of other antenna vibrators.

Figure 12:
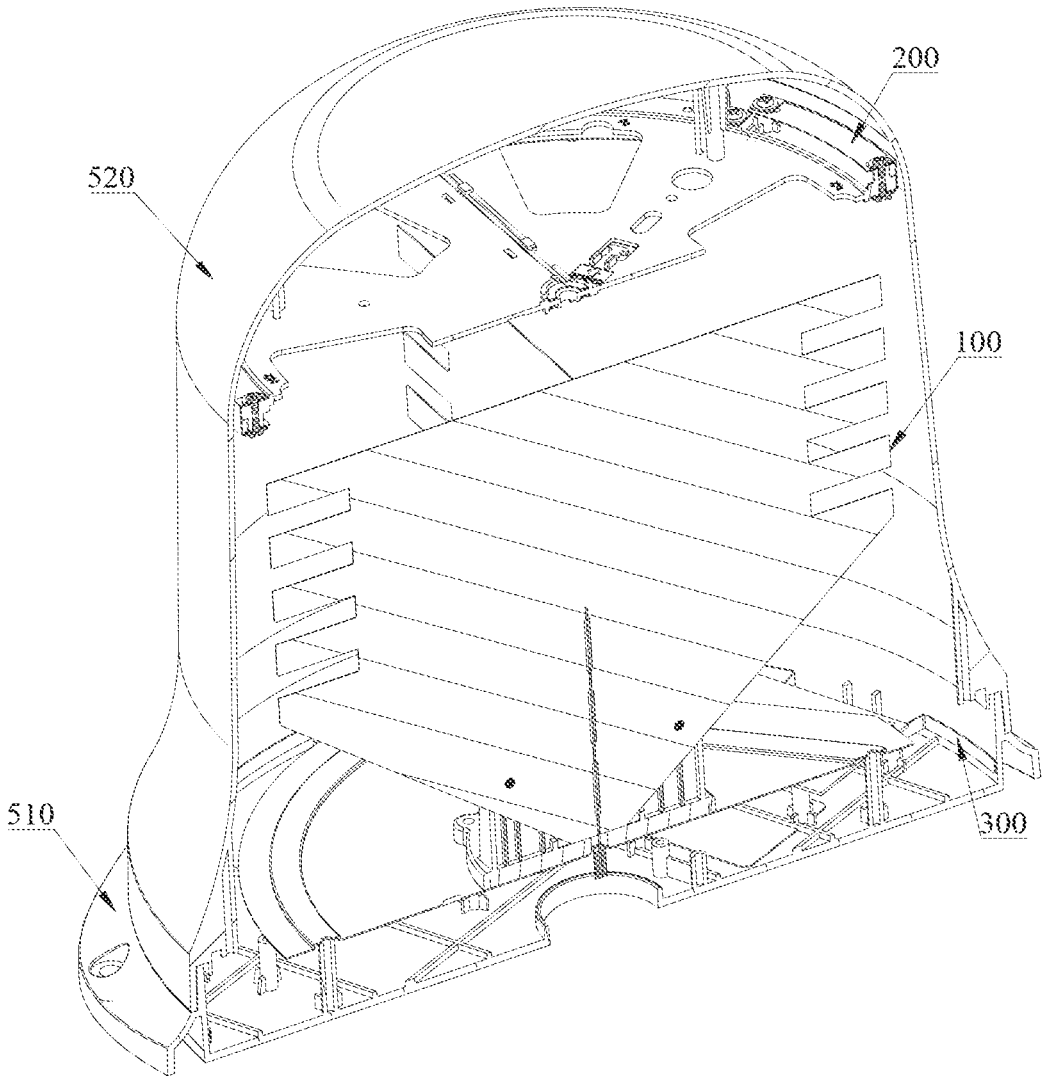
FIG. 12 is a cross-sectional view of the dual-polarization omnidirectional antenna.

As shown in FIG. 12, the dual-polarization omnidirectional antenna further includes a base 510 and a housing 520 covered above the base 510. A closed cavity is formed between the base 510 and the housing 520. The horizontally polarized omnidirectional antenna 200, the vertically polarized omnidirectional antenna 100, and the VHF vibrator 300 are sequentially arranged in the cavity in a top-down manner. The horizontally polarized omnidirectional antenna 200 is connected to the top of the housing 520 through the substrate 210 to be fixed, the main vibrator 110 of the vertically polarized omnidirectional antenna 100 is fixedly connected to an upper side of the insulating medium 120, the reference ground 130 is fixedly connected to a lower side of the insulating medium 120, and the insulating medium 120 is fixedly connected to the base 510 through the fastener, so as to ensure integrity between the main vibrator 110, the insulating medium 120 and the reference ground 130 and ensure stability of signal receiving. The VHF vibrator 300 surrounds an inner wall of the base 510.

It is apparent that the above embodiments of the present invention are merely examples for clear illustration, and are not intended to limit the implementations of the present invention. Modifications or changes in other various forms can be made by those ordinary skilled in the art on the basis of the above description. There is neither need nor exhaustion for all implementations. Any modification, equivalent substitution, improvement, or the like within the spirit and principle of the invention should be included in the scope of the claims of the invention.

The invention claimed is:

1. A vertically polarized omnidirectional antenna that is fed by a coaxial line including an inner conductor and an outer conductor, the vertically polarized omnidirectional antenna comprising:

a main vibrator;

an insulating medium; and a reference ground, wherein the main vibrator, the insulating medium, and the reference ground are sequentially stacked and sequentially connected in a top-down manner, the main vibrator includes two vibrator pieces arranged in a crisscross, a straight line where an intersecting line between the vibrator pieces is located perpendicularly passes through the center of the reference ground, a base angle of each vibrator piece is set to be a corner cut, the inner conductor passes through the center of the reference ground and the insulating medium and is connected with the bottom of the main vibrator, and the outer conductor is connected with the reference ground, and wherein an upper part of a side edge of each vibrator piece is provided with a plurality of strip-shaped notches arranged parallel to each other and parallel to a horizontal plane.

2. The vertically polarized omnidirectional antenna according to claim 1, wherein the strip-shaped notch has a width of 5 mm to 10 mm and a length of 10 mm to 40 mm.

3. The vertically polarized omnidirectional antenna according to claim 1, wherein the corner cut is chamfered from a middle part of a side edge of the vibrator piece to a middle part of a bottom edge of the vibrator such that a lower part of the vibrator piece is an inverted trapezoidal structure.

4. The vertically polarized omnidirectional antenna according to claim 1, wherein one vibrator piece of the main vibrator is provided with a gap extending to a middle part along a center line in a top-down manner, the other vibrator piece is provided with a gap extending to the middle part along the center line in a bottom-up manner, and the two vibrator pieces form a crisscross structure by fitting the gaps in a crossed manner.

5. The vertically polarized omnidirectional antenna according to claim 4, wherein two sides of each gap are symmetrical toothed structures.

6. The vertically polarized omnidirectional antenna according to claim 1, wherein the insulating medium is provided with four supports, each support is provided with a slot, the slots of the four supports form a cross matched with the main vibrator, and the vibrator piece is inserted into the slot to be fixed.

7. The vertically polarized omnidirectional antenna according to claim 6, wherein an inner side surface of the slot is provided with a plurality of protrusions.

8. The vertically polarized omnidirectional antenna according to claim 1, wherein the reference ground is punched with a convex groove or a concave groove.

9. A dual-polarization omnidirectional antenna that is provided with the vertically polarized omnidirectional antenna according to claim 1, the dual-polarization omnidirectional antenna further comprising:

a horizontally polarized omnidirectional antenna arranged at a distance above the vertically polarized omnidirectional antenna, wherein the horizontally polarized omnidirectional antenna includes a substrate and a vibrator, the vibrator is connected to a signal processor through a coaxial cable, the vibrator includes a wiring port that is arranged at the center of the substrate and is used to connect with the coaxial cable and a plurality of vibrator units distributed on the substrate in a circumferential array around the center of the substrate, the vibrator unit includes a radiating unit and a conducting unit, the radiating unit includes a first radiating sheet parallelly arranged on the substrate and a second radiating sheet vertically arranged on an edge of the substrate, an outer side edge of the first radiating sheet is connected with an inner side surface of the second radiating sheet, the conducting unit is parallelly arranged on the substrate, one end of the conducting unit is connected with one end of the first radiating sheet, and the other end is connected with the wiring port.

* * * * *